US011737615B2

(12) United States Patent
Hsu

(10) Patent No.: US 11,737,615 B2
(45) Date of Patent: Aug. 29, 2023

(54) SEALABLE WET TISSUE CONTAINER

(71) Applicant: DONZEE ENTERPRISE LTD., Taichung (TW)

(72) Inventor: Jin-Yang Hsu, Taichung (TW)

(73) Assignee: DONZEE ENTERPRISE LTD., Taichung (TW)

( * ) Notice: Subject to any disclaimer, the term of this patent is extended or adjusted under 35 U.S.C. 154(b) by 272 days.

(21) Appl. No.: 17/238,918

(22) Filed: Apr. 23, 2021

(65) Prior Publication Data

US 2022/0265097 A1 Aug. 25, 2022

(30) Foreign Application Priority Data

Feb. 23, 2021 (TW) ..... 110106324

(51) Int. Cl.

| | |
|---|---|
| ***A47K 10/38*** | (2006.01) |
| ***B65D 43/16*** | (2006.01) |
| ***B65D 1/40*** | (2006.01) |
| ***B65D 83/08*** | (2006.01) |
| *A47K 10/42* | (2006.01) |
| *A47K 10/32* | (2006.01) |

(52) U.S. Cl.

CPC ..... *A47K 10/38* (2013.01); *B65D 1/40* (2013.01); *B65D 43/162* (2013.01); *B65D 83/0805* (2013.01); *A47K 10/421* (2013.01); *A47K 2010/3266* (2013.01)

(58) Field of Classification Search

CPC ..... A47K 2010/3266; A47K 10/34; A47K 10/3643; A47K 10/38; A47K 10/3818; B65D 1/40; B65D 43/162; B65D 83/0805; B65D 83/08; B65D 25/52

See application file for complete search history.

(56) References Cited

U.S. PATENT DOCUMENTS

| | | | | |
|---|---|---|---|---|
| 6,889,867 | B1 * | 5/2005 | Smith | B65D 47/0838 |
| 9,072,414 | B2 * | 7/2015 | Riggs | A47K 10/3818 |
| 9,834,344 | B2 * | 12/2017 | Hsu | A47K 10/421 |
| 2021/0282605 | A1 * | 9/2021 | Miura | B65D 83/08 |
| 2022/0267082 | A1 * | 8/2022 | Utsunomiya | B65D 43/16 |

FOREIGN PATENT DOCUMENTS

TW I461335 B 11/2014

* cited by examiner

*Primary Examiner* — Patrick H Mackey

(74) *Attorney, Agent, or Firm* — Birch, Stewart, Kolasch & Birch, LLP

(57) ABSTRACT

A wet tissue container includes a container body having an opening and a cover structure covering the opening of the container body. The cover structure has a base with a hole, and a lid plate having a plurality of petal members annularly arranged in a way that a mouth is formed among the petal members. The lid plate is coupled to the hole of the base in a way that the lid plate is rotatable relative to the base.

10 Claims, 9 Drawing Sheets

SEALABLE WET TISSUE CONTAINER

BACKGROUND OF THE INVENTION

1. Field of the Invention

The present invention relates to a sealable container, and more particularly, to a sealable wet tissue container.

2. Description of the Related Art

Conventionally, wet tissues are kept in a hermetic container in order to keep moisture of the wet tissues and to prevent dirt from entering an inside of the container. Taiwan patent no. 1461335 discloses a wet tissue container provided at a side thereof with an opening, in which a lid having a plurality of elastic claws is mounted, for facilitating pull of the wet tissues. When the wet tissues are pulled out, because the elastic claws are deformable, the wet tissues can be dispensed through and held among the elastic claws in a way that the opening is still covered by the elastic claws so as to limit moisture loss. Specifically, the lid includes a base, and the elastic claws are radially and equiangularly extended from a periphery of the base towards a center of the lid, ensuring that a leading piece of the wet tissues is held by the deformable spaces among the elastic claws. In this way, the wet tissues inside the container can be continuously pulled out of the container with satisfied moisture.

In the conventional design, the elastic claws are generally formed with the base of the lid integrally, and the wet tissues are stored inside the container in a form of a roll piece by piece in a continuous manner. When the wet tissues are pulled out of the container one after another, the wet tissues are dispensed from a center of the roll out through the elastic claws and torn away from the roll along perforated lines for use. With this conventional design, the wet tissues tend to be twisted when they are pulled from the center and rotatably moved along the inner circumference of the roll, and further squeezed by the elastic claws when they are dispensed out of the container, resulting in wringing the wet tissues out and accidental break of the roll.

SUMMARY OF THE INVENTION

The present invention has been accomplished in view of the above-noted circumstances. It is an objective of the present invention to provide a sealable container for wet tissues, which can minimize the twist phenomenon of the wet tissue roll that is installed therein, thereby maintaining moisture.

To achieve the above-mentioned and other objectives, the present invention provides a wet tissue container comprising a container body and a cover structure. The container body comprises a bottom portion and a sidewall surrounding the bottom portion and having an opening opposite to the bottom portion. The bottom portion and the sidewall define an accommodating space for accommodating a tissue roll therein. The opening is in communication with the accommodating space. The cover structure is mounted to the container body to close the opening, and comprises a base, an upper cover, and a lid plate. The base has a hole. The upper cover is pivotally connected to the base in a way that the upper cover is configured to close the hole. The lid plate comprises an annular wall and a plurality of petal members annularly arranged in a way that a mouth is formed among the petal members. The lid plate is capped in the hole of the base in a way that the annular wall of the lid plate is rotatably coupled to a hole wall of the hole of the base, such that the lid plate is rotatable relative to the base.

The present invention is made to eliminate or at least minimize the twist phenomenon of the wet tissue roll when the tissue roll is drawn out continuously from the wet tissue container. The lid plate is rotatably coupled to the hole so that the lid plate can rotate upon receiving a twisting force generated from the pulling motion of the wet tissue roll to relieve the twisting force exerting on the wet tissue roll, thereby preventing the moisture of the wet tissue from wringing out.

Preferably, the annular wall of the lid plate is provided with a groove and the hole wall of the hole of the base is provided with an annular rib slidably engaged with the groove.

Preferably, the base is provided with a lower connecting portion surrounding the hole of the base, and the upper cover is provided with an upper connecting portion correspondingly and detachably engaged with the lower connecting portion to cover the hole of the base.

Preferably, the base is provided with a downwardly extending flange having an outwardly extending annular protrusion. The wet tissue container further includes a lower collar having a transversely extending lower shoulder and an upwardly extending engagement wall engaged with the annular protrusion of the base so as to fix the base.

The detailed structure, characteristics, assembly or use of the wet tissue container provided by the present invention will be described in the detailed description of the subsequent preferred embodiment. However, those with ordinary knowledge in the field of the present invention should be able to understand that these detailed descriptions and the specific preferred embodiment listed in the implementation of the present invention are only used to illustrate the present invention, and are not intended to limit the scope of the patent application of the present invention.

DETAILED DESCRIPTION OF THE INVENTION

Figure 1:
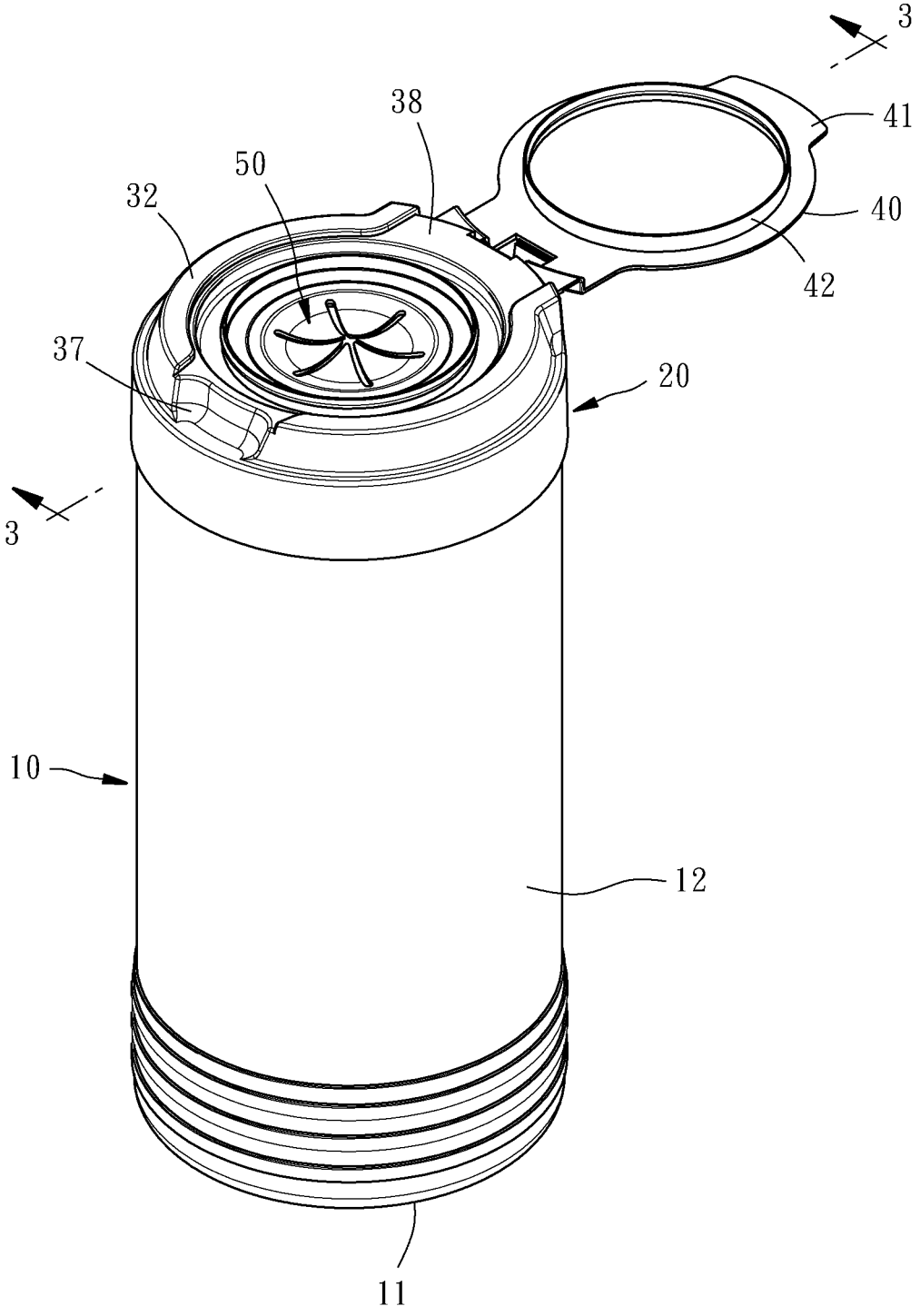
FIG. 1 is a perspective view showing a sealable wet tissue container in accordance with a first embodiment of the present invention.
Figure 2:
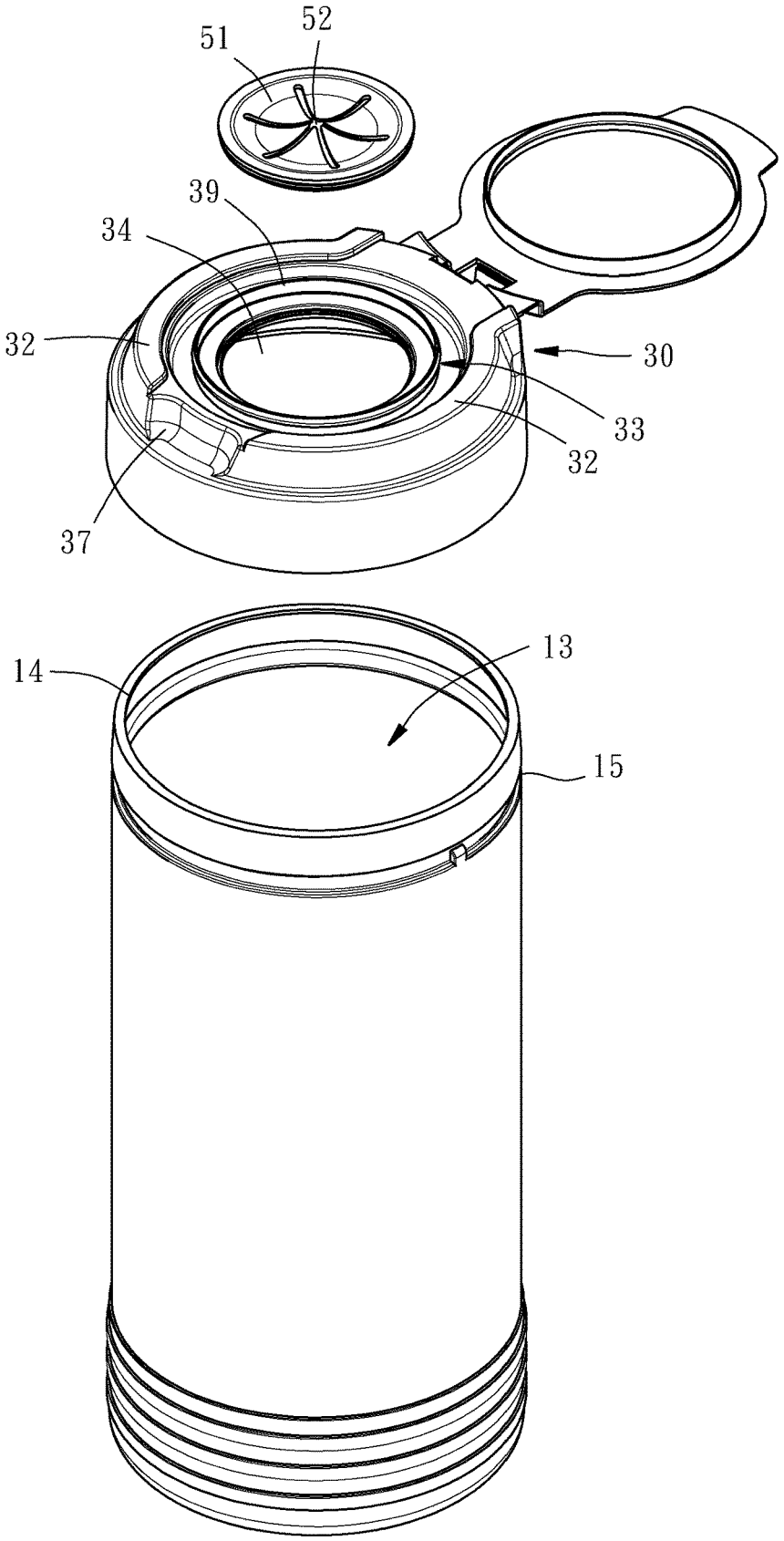
FIG. 2 is an exploded perspective view of the sealable wet tissue container shown in FIG. 1.

The applicant first explains here, the following is a detailed description of the technical content and features of the present invention by means of the preferred embodiment shown in conjunction with the drawings. Those skilled in the art can understand that the explanatory terms of this embodiment belong to the upper-level description that does not limit the application field. For example, the terms of shape or material include but are not limited to the material or shape specified in the description. In addition, the directional adjectives such as "top, bottom, up, down, inside, and outside" mentioned in the content of this description are only exemplary descriptive terms on the normal direction of use, and are not intended to limit the scope of claims. Furthermore, in the preferred embodiment and drawings to be introduced below, the same element numbers represent the same or similar elements or their structural features.

Referring to FIGS. 1-5, a sealable wet tissue container provided by a first embodiment of the present invention is composed of a container body 10 and a cover structure 20.

In this embodiment, the container body 10 is a cylindrical barrel; however, the container body is not limited thereto. For example, a cube box or other geometric shaped containers can be utilized to serve as the container body 10. The container body 10 has a bottom portion 11 and an annular sidewall 12 surrounding the bottom portion 11 and defining with the bottom portion 11 an accommodating space 13 therebetween for receiving a wet tissue roll. The annular sidewall 12 is provided at a top end thereof with an opening 14 opposite to the bottom portion 11 and at an outer perimeter thereof with an annular groove 15 located adjacent to the opening 14.

The cover structure 20 is rotatably and detachably mounted to the container body 10 to close the opening 14 of the container body 10. The cover structure 20 comprises a base 30, which is detachably capped on the container body 10 to close the opening 14 of the container body 10, an upper cover 40 pivotally connected to the base 30, and a lid plate 50.

In this embodiment, the base 30 includes a downwardly extending flange 31 having an annular shape and provided at an inner perimeter thereof with an annular protrusion 36. By fitting the annular protrusion 36 into the annular groove 15 of the container body 10, the base 30 can be easily mounted to the container body 10 to close the opening 14 of the container body 10. The base 30 is provided with a hole 34, a pair of upwardly extending arched shoulders 32, which are spacedly arranged at two opposite sides of the hole 34 with their concave surfaces facing to each other, an annular rib 35 provided at the hole wall surrounding the hole 34, a locating groove 33 and a lower connecting portion 39. The locating groove 33 and the lower connecting portion 39 surround around the hole 34 respectively, in which the lower connecting portion 39 is located between the locating groove 33 and the hole 34, and the locating groove 33 is located between the arched shoulders 32 and the lower connecting portion 39. Further, the height of the arched shoulders 32 is higher than the height of the locating groove 33. The base 30 further comprises a notch 37 located between first ends of the two arched shoulders 32, and an upper cover connecting region 38 located between second ends of the two arched shoulders 32 opposite to the notch 37.

The upper cover 40 is pivotally connected to a lateral side of the upper cover connecting region 38, and able to be capped on the locating groove 33. The upper cover 40 is provided at a lateral side thereof with a tab 41 and at a bottom side thereof with an upper connecting portion 42, which is formed to match with the lower connecting portion 39. In this embodiment, the diameter of the upper connecting portion 42 is slightly larger than the diameter of the lower connecting portion 39, so that when the upper cover 40 is covered on the hole 34, the upper connecting portion 42 is located in the locating groove 33 between the arched shoulders 32 and the lower connecting portion 39 in a way that the inner surface of the upper connecting portion 42 is abutted against the outer surface of the lower connecting portion 39, and the tab 41 is correspondingly protruded over the notch 37.

The lid plate 50 has a circle shape and comprises a plurality of petal members 51 annularly arranged in a way that a mouth 52 is formed among the petal members 51 for the pass of the wet tissues therethrough. The lid plate 50 is provided at a bottom side thereof with an annular wall 53. The annular wall 53 is provided at an outer periphery thereof with a groove 54 and at an end edge thereof with a hook 55. The lid plate 50 is coupled to the hole 34 of the base 30 in a way that the annular rib 35 of the base 30 is slidably engaged into the groove 54 of the lid plate 50, such that the lid plate 50 is rotatably coupled to the hole 34, i.e., the lid plate 50 is freely rotatable relative to the base 30.

Figure 3:
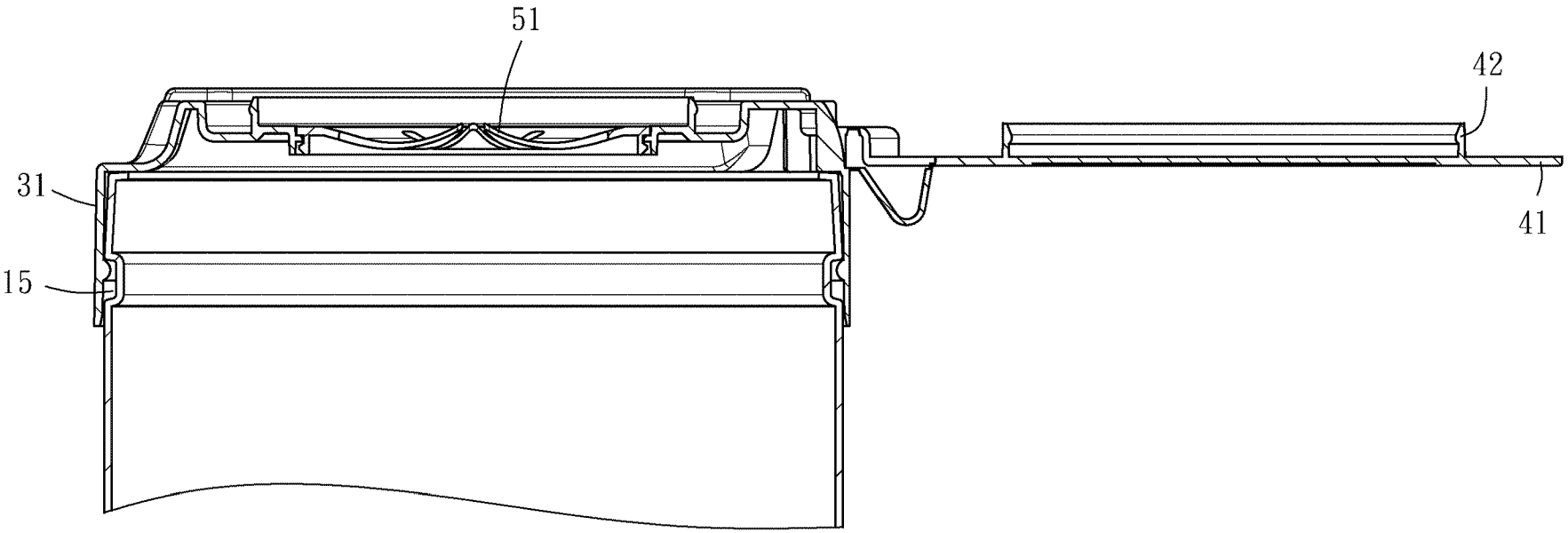
FIG. 3 is a sectional view taken along line 3-3 of FIG. 1, showing an upper cover of the wet tissue container is not capped on a base of the wet tissue container.
Figure 4:
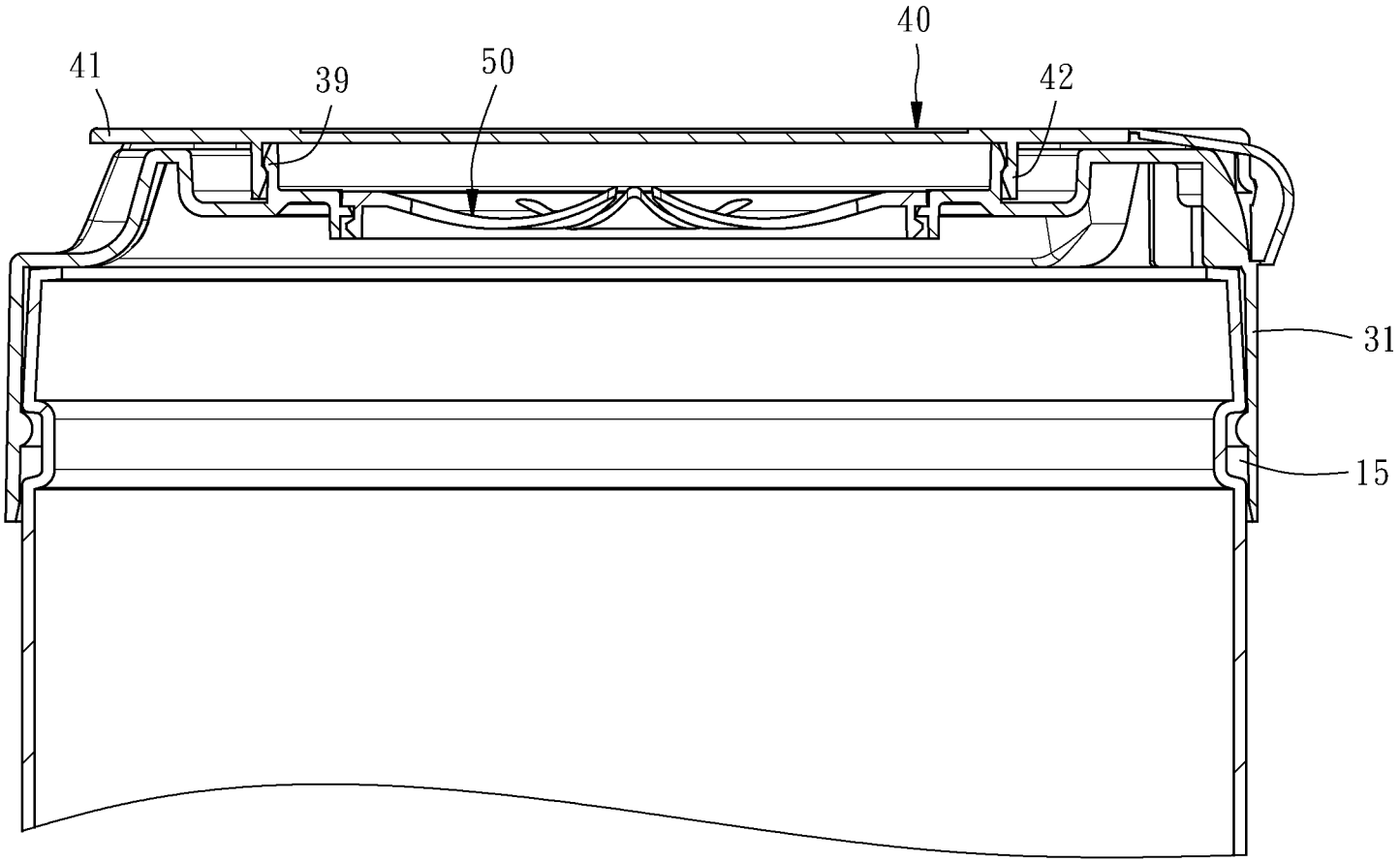
FIG. 4 is similar to FIG. 3, but showing the upper cover of the wet tissue container is capped on the base of the wet tissue container.
Figure 5:
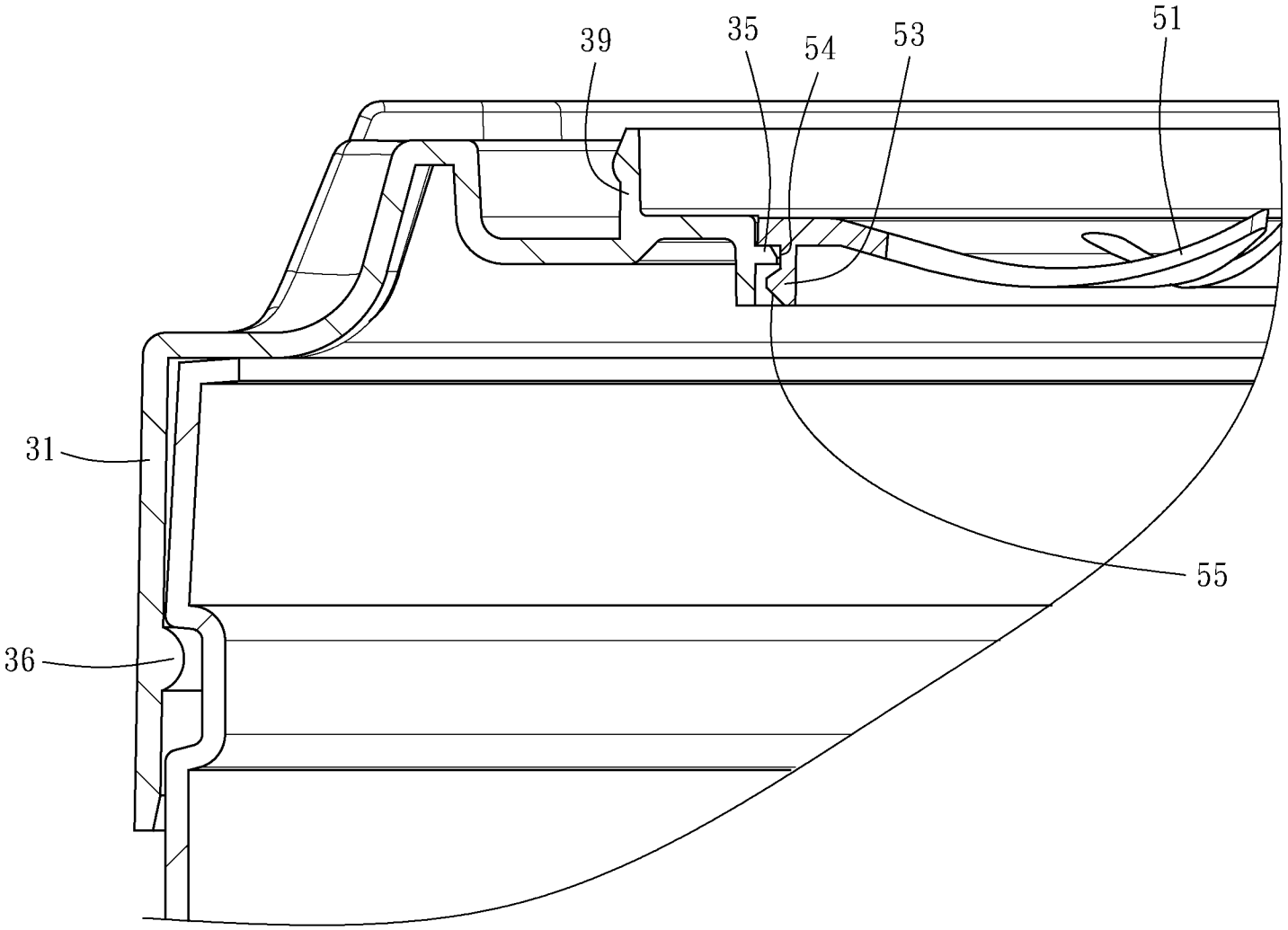
FIG. 5 is a partially enlarged view of FIG. 3.

Based on the above-mentioned structural features of the wet tissue container, the wet tissue roll is accommodated in the wet tissue container with the leading piece of the wet tissues partially drawn out through the mouth 52 and held by the petal members 51. Referring to FIG. 4, when the hole 34 is closed by the upper cover 40, the upper connecting portion 42 is detachably engaged to the lower connecting portion 39, thereby keeping moisture and clean of the wet tissue roll inside the wet tissue container. When the wet tissues are to be used, the upper cover 40 can be easily opened by flipping the tab 41 upwardly, as shown in FIG. 3, and then the wet tissues can be pulled out. In the present invention, because the lid plate 50 is rotatably coupled to the hole 34 of the base 30, the lid plate 50 can freely rotate relative to the base 30 upon receiving a twisting force. As a result, when the tissues of the roll are continuously drawn out of the wet tissue container, the twisting force generated from the pulling motion of the wet tissue roll will exert on the lid plate 50 to force the lid plate 50 to synchronously rotate relative to the base 30 so as to minimize the twisting degree of the wet tissue roll. With the aforesaid technical features and effect, the disadvantage of the wet tissue container of prior art can be improved.

Figure 6:
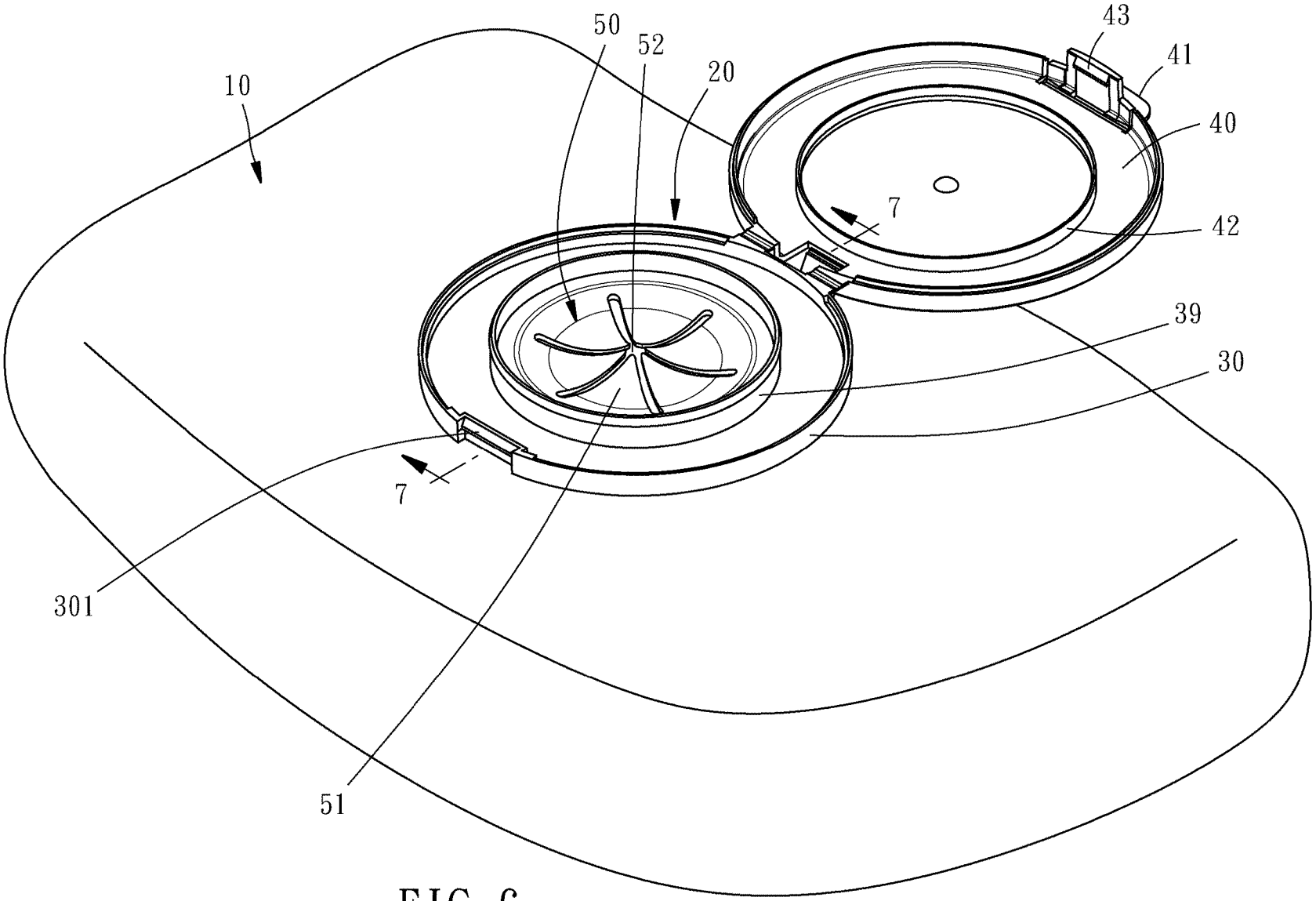
FIG. 6 is a perspective view showing a sealable wet tissue container in accordance with a second embodiment of the present invention.
Figure 7:
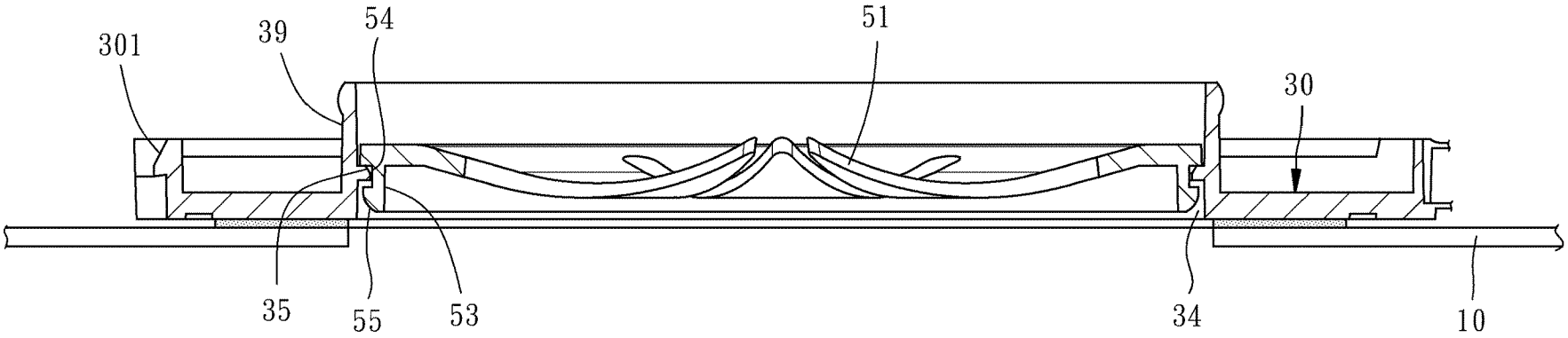
FIG. 7 is a sectional view taken along line 7-7 of FIG. 6.

FIGS. 6 and 7 illustrate a sealable wet tissue container in accordance with a second embodiment of the present invention, which comprises a container body 10 and a cover structure 20.

The container body 10 has an accommodating space for receiving wet tissues. In this embodiment, the container body 10 is realized as a bag; however, the container body 10 is not limited thereto. For example, a barrel, a can or a box may serve as the container body 10.

The cover structure 20 is firmly adhered on one side of the container body 10. The cover structure 20 comprises a base 30, an upper cover 40, and a lid plate 50.

The base 30 includes a hole 34, an annular rib 35 provided at the hole wall surrounding the hole 34, a lower connecting portion 39 extending upwardly and surrounding around the hole 34, and a hook 301 at one lateral side of the base 30.

The upper cover 40 is configured to be pivotally connected to a lateral side of the base 30 for covering the hole 34. The upper cover 40 comprises an upper connecting portion 42 to couple with the corresponding lower connecting portion 39 so as to cover the hole 34. A tab 41 is formed on one side of the upper cover 40 and a connecting protrusion 43 is extended outwardly from one side of the tab 41 to be coupled to the hook 301 for allowing the upper cover 40 to securely cap on the hole 34.

The lid plate 50 has a circle shape and comprises a plurality of petal members 51 annularly arranged in a way that a mouth 52 is formed among the petal members 51 for the pass of the wet tissues therethrough. The lid plate 50 is provided at a bottom side thereof with an annular wall 53. The annular wall 53 is provided at an outer periphery thereof with a groove 54 and at an end edge thereof with a hook 55. The lid plate 50 is coupled to the hole 34 of the base 30 in a way that the annular rib 35 of the base 30 is slidably engaged into the groove 54 of the lid plate 50, such that the lid plate 50 is rotatably coupled to the hole 34, i.e., the lid plate 50 is freely rotatable relative to the base 30.

The difference between this embodiment and the first embodiment lies in that the base 30 of this embodiment does not provide a downwardly extending flange, but is directly adhered on the bag-like container body 10. With the feature that the lid plate 50 can freely rotate relative to the base 30, the twist of the wet tissue roll can be eliminated or at least minimized, thereby preventing the moisture of the wet tissue from wringing out.

Figure 8:
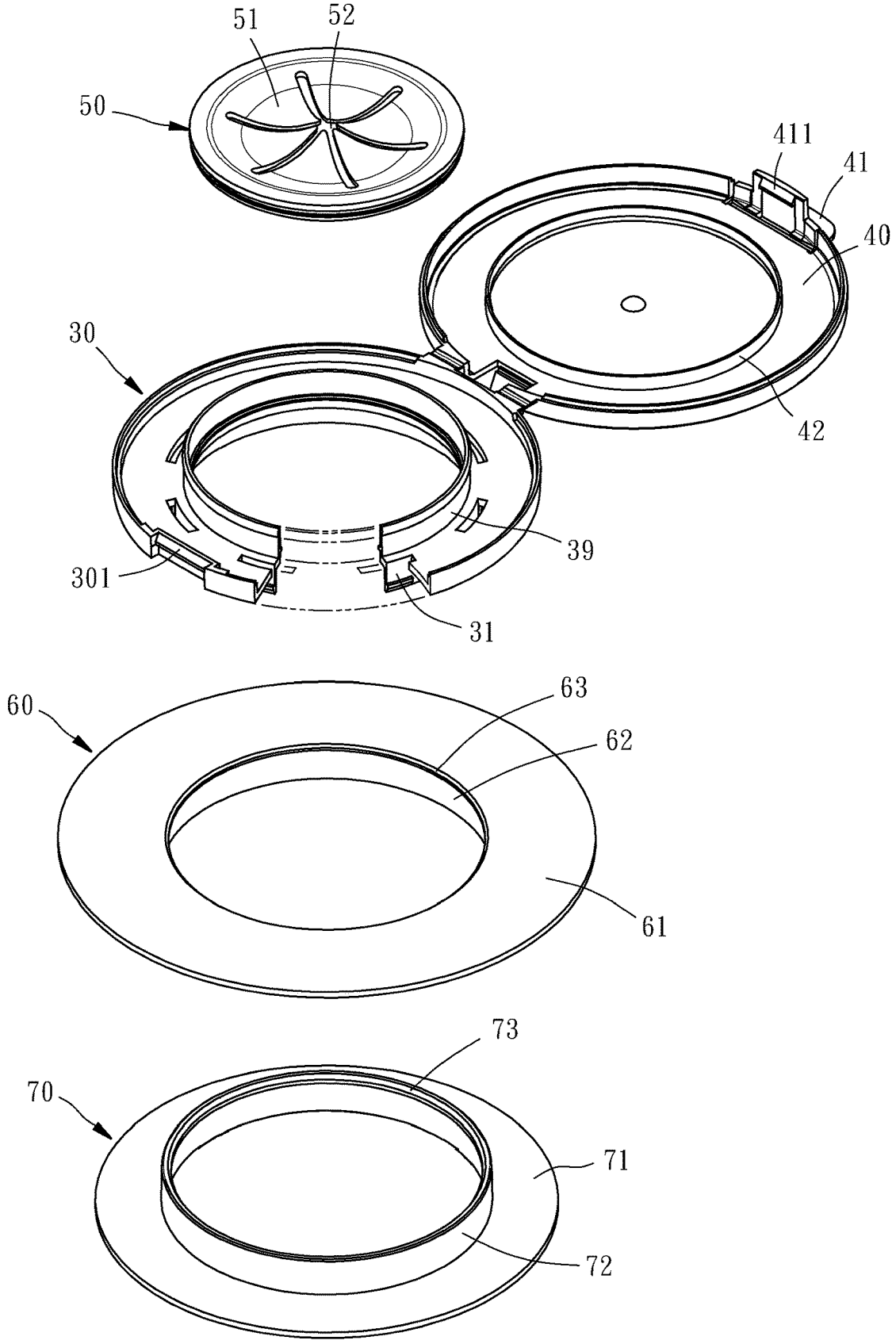
FIG. 8 is an exploded perspective view of a cover structure in accordance with a third embodiment of the present invention.
Figure 9:
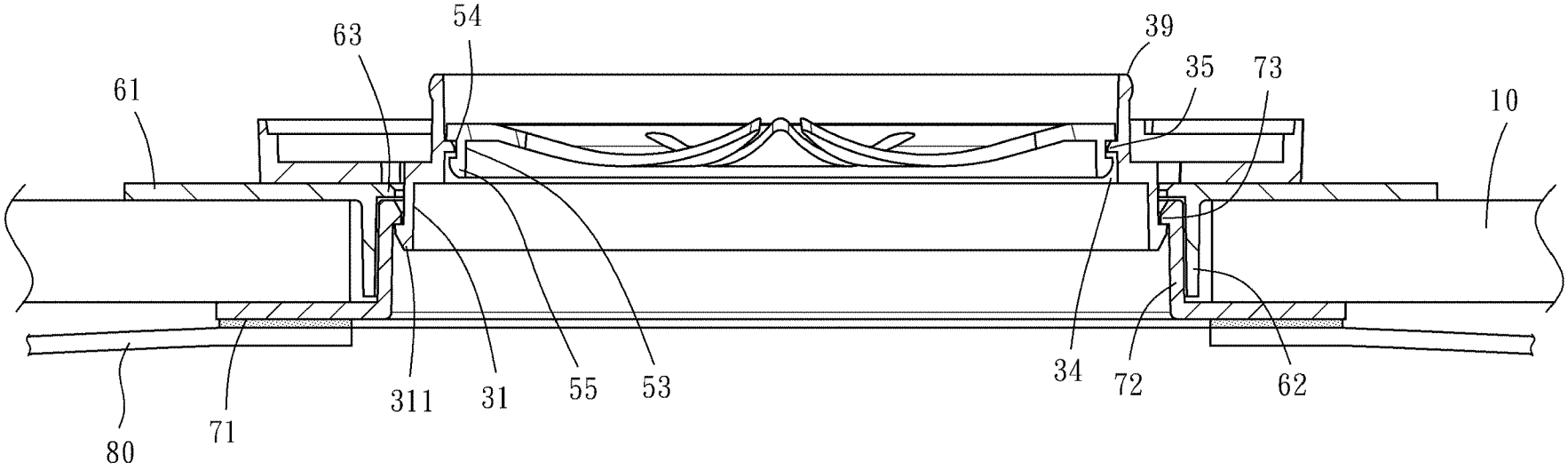
FIG. 9 is a sectional view of a sealable wet tissue container using the cover structure in accordance with the third embodiment of the present invention.

FIG. 8 shows a cover structure in accordance with a third embodiment of the present invention, which is adapted for being used with a box-like hermetic container body, and FIG. 9 illustrates a sealable wet tissue container using the cover structure. In this embodiment, the sealable wet tissue container comprises the following elements.

A container body 10 has a bottom portion, an annular sidewall surrounding the bottom portion and defining with the bottom portion an accommodating space therebetween for receiving a wet tissue roll, and an opening opposite to the bottom portion in communication with the accommodating space. In this embodiment, the container body 10 is realized as a box; however, the container body 10 is not limited thereto. For example, a barrel or a can may serve as the container body 10.

A base 30 includes a downwardly extending flange 31 having an outwardly extending annular protrusion 311 at an outer perimeter of the flange 31. The base 30 is further provided with a hole 34, an annular rib 35 provided at the hole wall surrounding the hole 34, a lower connecting portion 39 annularly surrounding around the hole 40, and a hook 301 at one lateral side of the base 30.

An upper cover 40 is configured to be pivotally connected to a lateral side of the base 30 for covering the hole 34. The upper cover 40 comprises an upper connecting portion 42 to couple with the corresponding lower connecting portion 39. By means of the coupling arrangement between the upper and lower connecting portions 42 and 39, the upper cover 40 can firmly and stably cover the hole 34. A tab 41 is formed on one side of the upper cover 40 and a connecting protrusion 411 is extended outwardly from one side of the tab 41 to be coupled to the hook 301 for allowing the upper cover 40 to securely cap on the hole 34.

A lid plate 50 has a circle shape and comprises a plurality of petal members 51 annularly arranged in a way that a mouth 52 is formed among the petal members 51 for the pass of the wet tissues therethrough. The lid plate 50 is provided at a bottom side thereof with an annular wall 53. The annular wall 53 is provided at an outer periphery thereof with a groove 54 and at an end edge thereof with a hook 55. The lid plate 50 is coupled to the hole 34 of the base 30 in a way that the rib 35 of the base 30 is slidably engaged into the groove 54 of the lid plate 50, such that the lid plate 50 is rotatably coupled to the hole 34, i.e., the lid plate 50 is freely rotatable relative to the base 30.

An upper collar 60 is disposed between the container body 10 and the base 30. The upper collar 60 has a transversely extending upper shoulder 61 and a downwardly extending stop wall 62. The upper shoulder 61 surrounds around the stop wall 62 and is provided with a flange 63 protruding towards a center of the upper collar 60.

A lower collar 70 has a transversely extending lower shoulder 71 and an upwardly extending engagement wall 72. The engagement wall 72 is provided with a lower collar hook 73 protruding towards a center of the lower collar 70.

As shown in FIG. 9, in this third embodiment, the upper collar 60 and the lower collar 70 are used to clamp the container body 10. In more detail, to clamp the container body 10 by using the upper collar 60 and the lower collar 70, the upper collar 60 is disposed at an external side of the container body 10 in a way that the stop wall 62 is inserted downwardly into the opening of the container body 10, and then the lower collar 70 is disposed at an internal side of the container body 10 in a way that the engagement wall 72 extends upwardly through the opening, and is abutted against the stop wall 62 in a way that the top edge of the engagement wall 72 is stopped at the flange 63. Thereafter, the base 30 is secured to the lower collar 70 in such a way that the annular protrusion 311 is hooked on the lower collar hook 73, such that the flange 63 of the upper collar 60 is clamped between the base 30 and the upper edge of the engagement wall 72 of the lower collar 70 to achieve a stable assembly. In this way, the base 30 is firmly coupled with the upper and lower collars 60 and 70, and the container body 10 is clamped between the upper shoulder 61 and the lower shoulder 71. Further, the lower shoulder 71 is adhered to a bag 80 in which a wet tissue roll is received.

Thus, as explained above, in the third embodiment, the cover structure can, but not limited to, be used to all kinds of hermetic containers, such a box, bucket, barrel, can, etc. When the wet tissues are continuously drawn out of the wet tissue container 10, the twist of the wet tissue roll can be eliminated or at least minimized thanks to the structural feature that the lid plate 50 is freely rotatable relative to the base 30, thereby preventing the moisture of the wet tissue from wringing out.

What is claimed is:

1. A wet tissue container, comprising:

a container body comprising a bottom portion, a sidewall surrounding the bottom portion and having an opening opposite to the bottom portion, the bottom portion and the sidewall defining an accommodating space for receiving a tissue roll; and a cover structure mounted to the container body to close the opening, the cover structure comprising:

a base having a hole and a rib provided at a hole wall surrounding the hole;

an upper cover pivotally connected to the base in a way that the upper cover is configured to close the hole; and a lid plate comprising an annular wall, a plurality of petal members annularly arranged in a way that a mouth is formed among the petal members, and a groove provided at the annular wall and engaged with the rib of the base in a way that the lid plate is rotatable relative to the base.

2. The wet tissue container as claimed in claim 1, wherein the base comprises a lower connecting portion surrounding around the hole, the upper cover comprises an upper connecting portion matching the lower connecting portion, and the upper connecting portion is detachably engaged with the lower connecting portion, such that the upper cover covers over the hole.

3. The wet tissue container as claimed in claim 2, wherein the sidewall of the container body comprises an annular groove located adjacent to the opening; the base has a downwardly extending flange; the downwardly extending flange is provided at an inner perimeter thereof with an annular protrusion engaged with the annular groove of the sidewall of the container body.

4. The wet tissue container as claimed in claim 2, wherein the base comprises a downwardly extending flange having an outwardly extending annular protrusion.

5. The wet tissue container as claimed in claim 4, further comprising an upper collar disposed between the container body and the base; the upper collar has a transversely extending upper shoulder and a downwardly extending stop wall; the transversely extending upper shoulder surrounds around the downwardly extending stop wall.

6. The wet tissue container as claimed in claim 5, further comprising a lower collar having a transversely extending lower shoulder and an upwardly extending engagement wall; the upwardly extending engagement wall is provided with a lower collar hook protruding towards a center of the lower collar.

7. The wet tissue container as claimed in claim 6, wherein the container body is clamped between the transversely extending upper shoulder of the upper collar and the transversely extending lower shoulder of the lower collar.

8. The wet tissue container as claimed in claim 7, wherein the upper collar is provided with a flange protruding towards a center of the upper collar.

9. The wet tissue container as claimed in claim 8, wherein the outwardly extending annular protrusion of the downwardly extending flange of the base is engaged with the hook of the upwardly extending engagement wall of the lower collar, such that the flange of the upper collar is clamped between the base and an upper edge of the upwardly extending engagement wall.

10. The wet tissue container as claimed in claim 9, wherein the base is provided at a lateral side thereof with a hook; the upper cover comprises a tab and a connecting protrusion extended outwardly from the tab; the connecting protrusion of the upper cover is detachably engaged to the hook of the base when the upper cover closes the hole of the base.

* * * * *